US006419202B1

(12) United States Patent
Thurner

(10) Patent No.: US 6,419,202 B1
(45) Date of Patent: Jul. 16, 2002

(54) CHRISTMAS-TREE STAND

(75) Inventor: Guenter Thurner, Strasskirchen (DE)

(73) Assignee: Klaus Krinner, Strasskirchen (DE)

( * ) Notice: Subject to any disclaimer, the term of this patent is extended or adjusted under 35 U.S.C. 154(b) by 0 days.

(21) Appl. No.: 09/481,656

(22) Filed: Jan. 11, 2000

(30) Foreign Application Priority Data

Jan. 29, 1999 (DE) ..... 199 03 634

(51) Int. Cl.[7] ..... F16M 13/02

(52) U.S. Cl. ..... 248/525; 248/519; 248/520; 248/523; 248/524; 248/526

(58) Field of Search ..... 248/519, 523, 248/524, 520, 526, 525

(56) References Cited

U.S. PATENT DOCUMENTS

| | | | | | |
|---|---|---|---|---|---|
| 5,114,113 | A | * | 5/1992 | Krinner | 248/525 |
| 5,160,110 | A | * | 11/1992 | Praegitzer | 248/519 |
| 5,464,186 | A | * | 11/1995 | Robert | 248/524 |
| 5,490,350 | A | * | 2/1996 | Eisenschenk et al. | 47/40.5 |
| 5,707,037 | A | * | 1/1998 | Pastrick | 248/516 |
| 5,918,849 | A | * | 7/1999 | Bliss | 248/523 |
| 6,012,698 | A | * | 1/2000 | Hardt et al. | 248/523 |
| 6,019,341 | A | * | 2/2000 | Brown et al. | 248/516 |
| 6,042,077 | A | * | 3/2000 | Shoesmith | 248/523 |
| 6,094,859 | A | * | 8/2000 | Kalman et al. | 47/40.5 |
| 6,095,480 | A | * | 8/2000 | Mutschler | 248/524 |

FOREIGN PATENT DOCUMENTS

| | | |
|---|---|---|
| DE | 3932473 C2 | 4/1991 |
| DE | 9216396 | 5/1994 |
| WO | WO 97/10741 | 3/1997 |

* cited by examiner

*Primary Examiner*—Leslie A. Braun
*Assistant Examiner*—Steven M. Marsh
(74) *Attorney, Agent, or Firm*—Jordan and Hamburg LLP

(57) ABSTRACT

The invention relates to a stand, particularly a stand for the substantially vertical erection of trunks of Christmas trees with adaptation to different sizes and characteristics of the trunks of Christmas trees, with a housing, with a receiving region for the trunk, with a clamping apparatus and with swivel-mounted holding elements, said holding elements being adapted to be swivelled by means of a force-transmission element and the clamping apparatus from and to the longitudinal axis of the trunk of the Christmas tree between an open position, receiving position, for receiving the trunk and a closed position, holding position, for holding the trunk. The housing is of one-part design and the holding elements are mounted on the one-part housing.

32 Claims, 6 Drawing Sheets

CHRISTMAS-TREE STAND

BACKGROUND OF THE INVENTION

The invention relates to a stand, particularly a stand for the substantially vertical erection of trunks of Christmas trees.

A known stand has long been marketed with great success by the company Krinner GmbH in the form of its Multifix Vario model. In these known stands, the housing consists of a metal base plate and a plastic cover bolted onto the base plate. This design of the housing is structurally complex and results in a considerable weight of the stand.

SUMMARY OF THE INVENTION

The object of the present invention, therefore, is creating a structurally simpler, easy- and safe-to-use stand. The one-part design of the housing and the mounting of the holding elements on the housing according to the invention represent a design which is very simple and low-cost in terms of manufacture and assembly, it being possible, on account of the dimensional stability of the one-part housing, to employ a smaller wall thickness of the housing and, consequently, to achieve a lower weight of the stand. The use of thinner-walled materials also results in the cost-effective saving of material. The continuous flowing form of the housing, made possible by the one-part design of the housing, is aesthetically more pleasing and attractive than a design involving merely functionally joined components.

The manufacturing process is made especially simple if the housing is formed from a deep-drawn metal sheet. In this case, the housing according to the invention can be formed using one single tool in one single operation and, therefore, in a very time- and cost-saving manner.

In a preferred embodiment, the Christmas-tree stand is made of an iron alloy or aluminum alloy. This provides the Christmas-tree stand with a high degree of resistance to deformations and also to impacts and applications of force (scratches) from hard objects and with a significantly longer useful life, because such materials are more resistant to weathering than, for example, plastics or wood. Furthermore, iron or aluminum alloys represent a suitable base surface for painting.

In an embodiment of the invention, the receiving region for the trunk is in the form of a pot which can in advantageous manner be deep-drawn from a metal sheet together and in one piece with the housing.

BRIEF DESCRIPTION OF THE DRAWINGS

Hereinbelow, further advantages, features and possible uses of the invention will be explained in detail on the basis of example embodiments with reference to the appended drawings, in which.

DETAILED DESCRIPTION OF THE INVENTION

Figure 1:
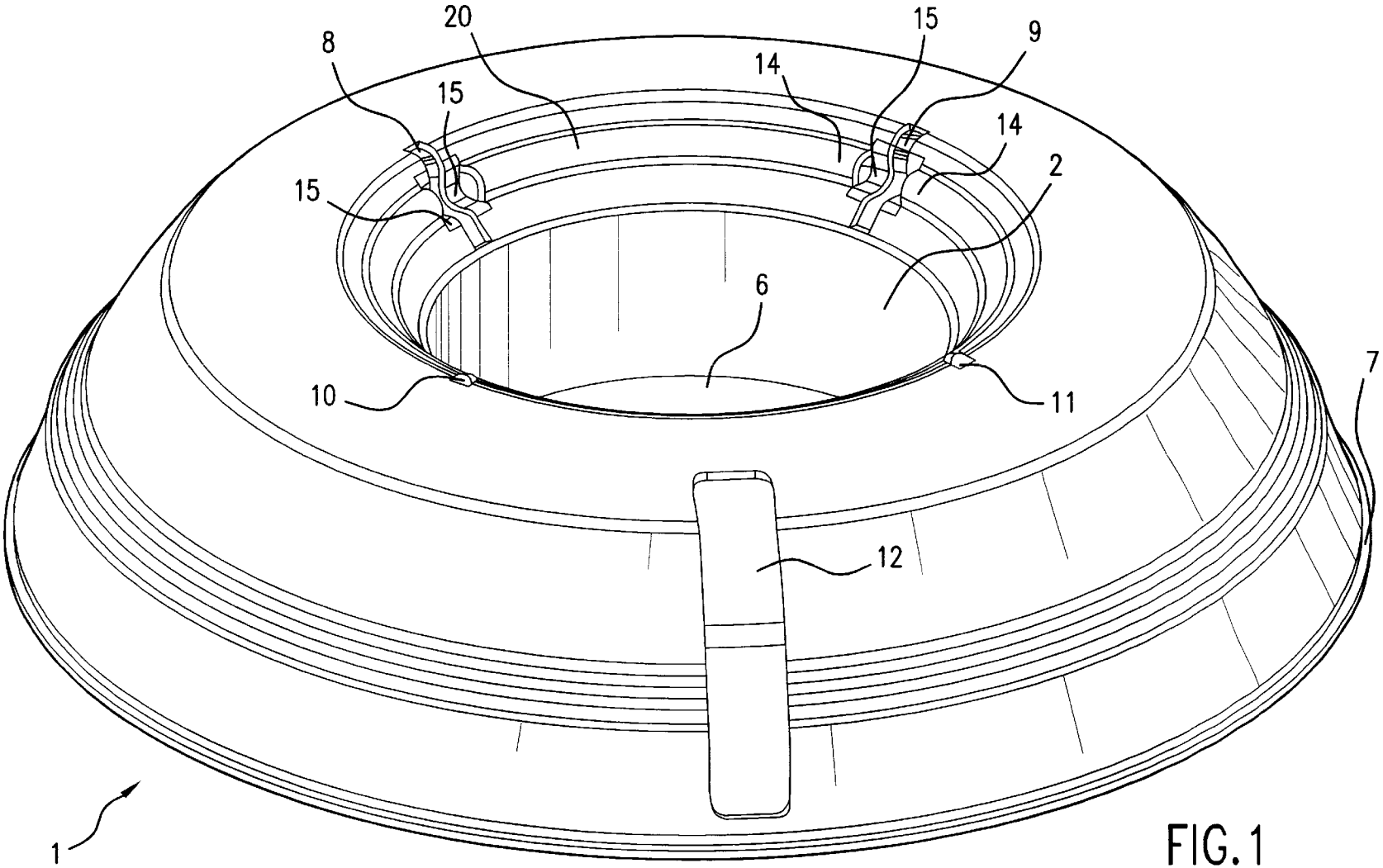
FIG. 1 shows a perspective view of an embodiment of a housing of the Christmas-tree stand according to the invention.
Figure 2:
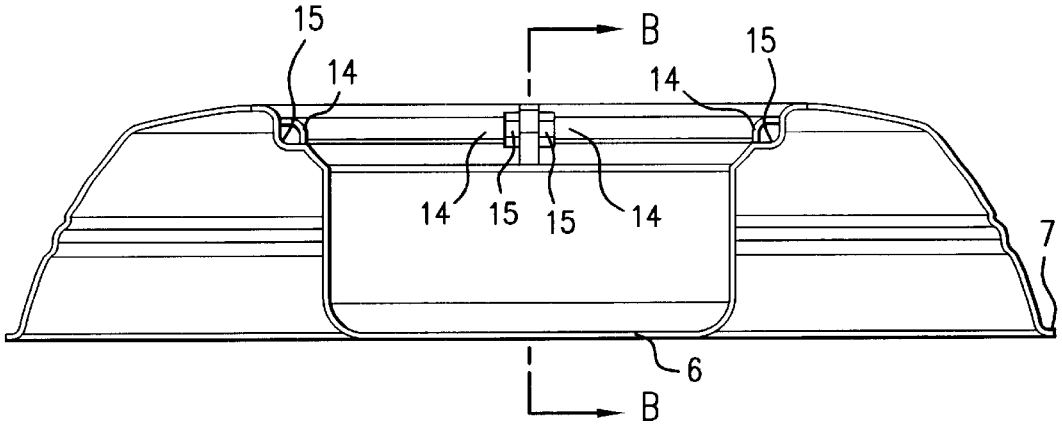
FIG. 2 shows a schematic cross-sectional view of the housing shown in FIG. 1.
Figure 3:
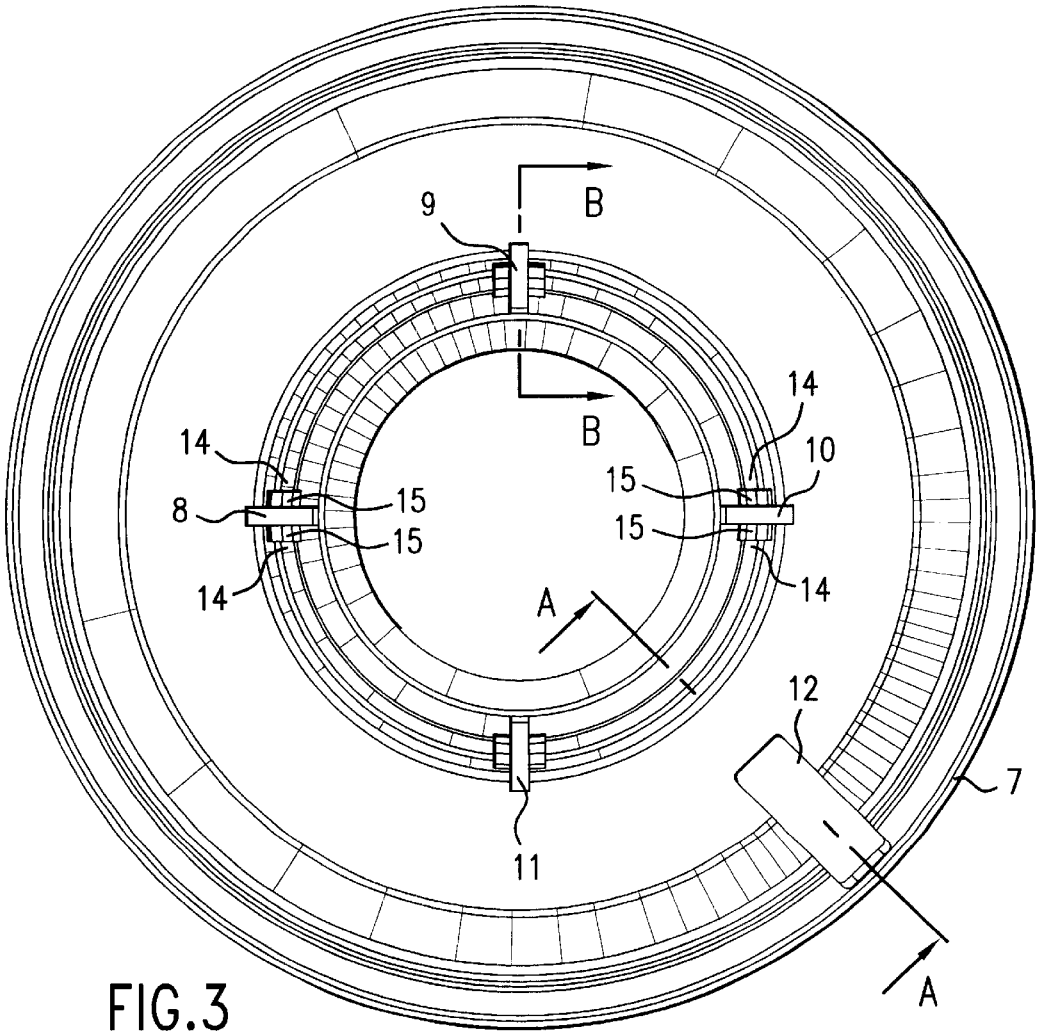
FIG. 3 shows a top view of the housing shown in FIG. 1.
Figure 4:
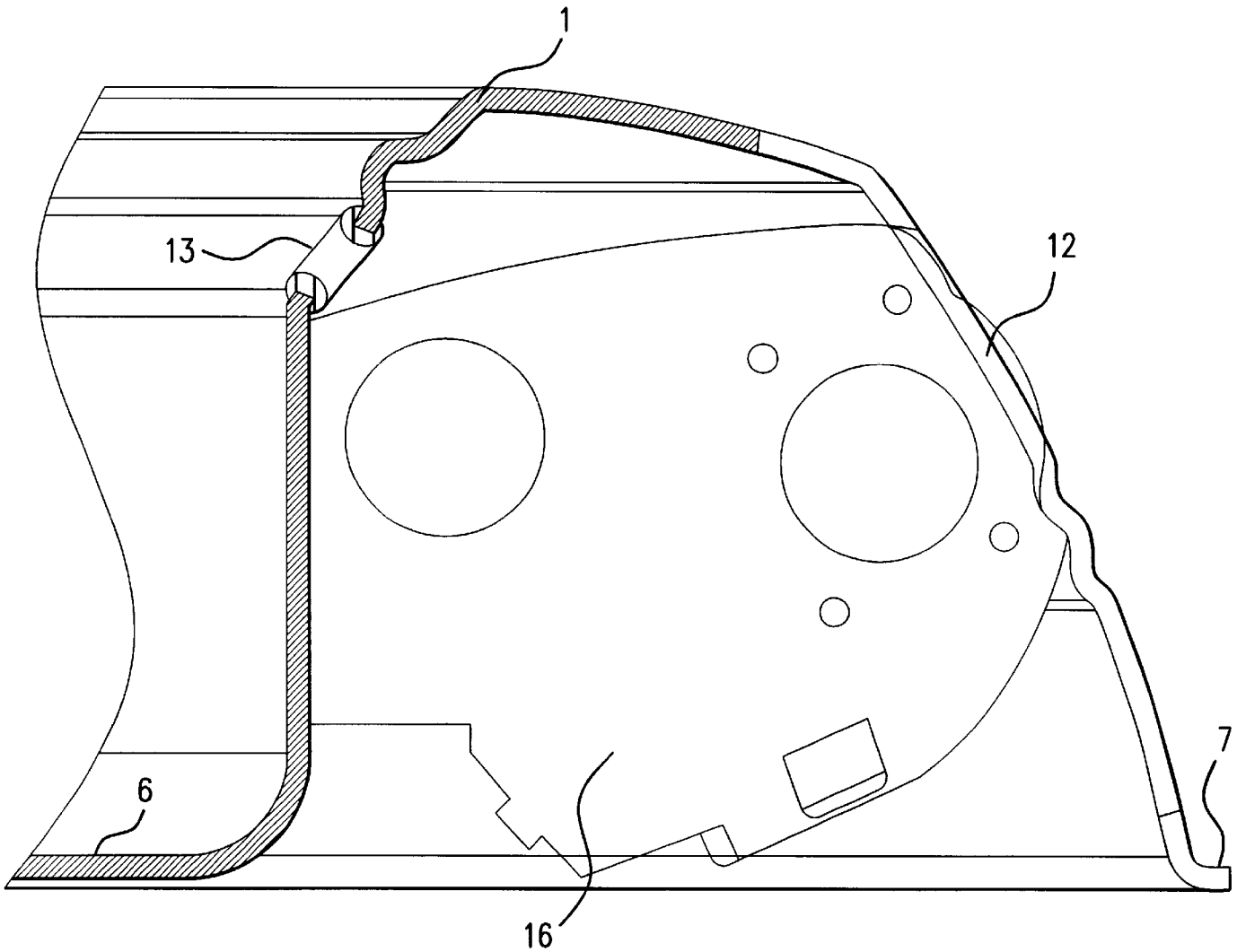
FIG. 4 shows a cross-sectional view along line A—A in FIG. 3.
Figure 5:
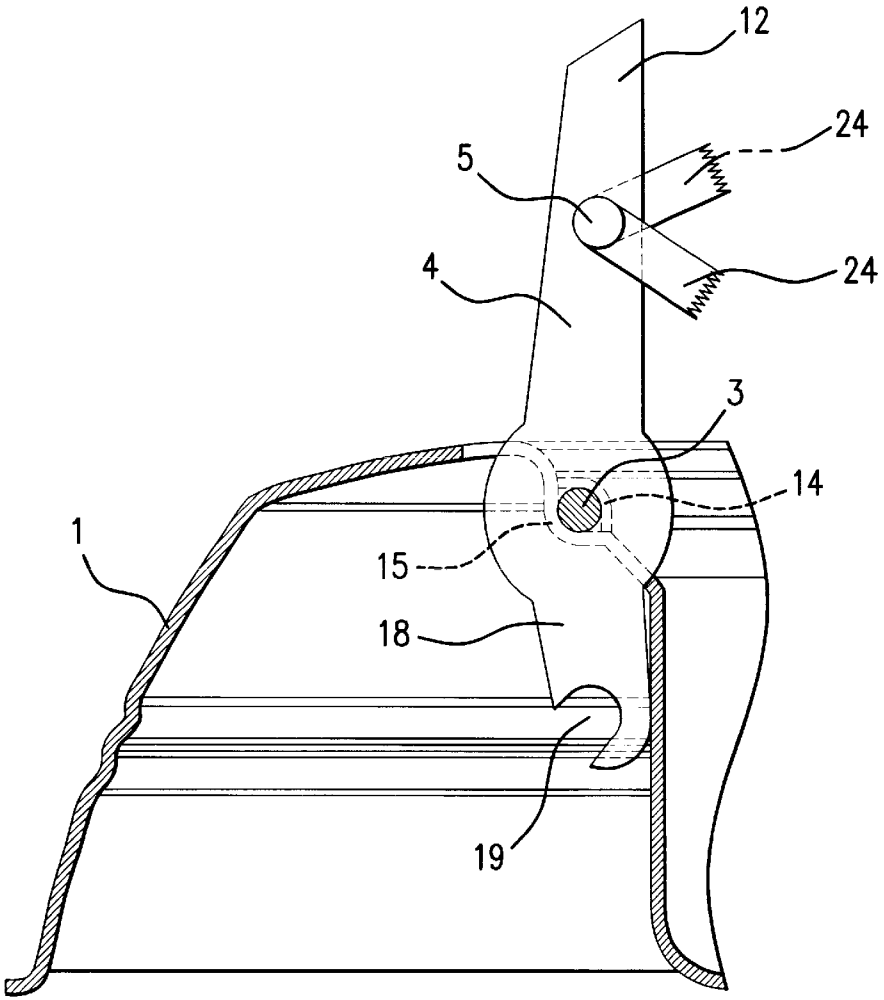
FIG. 5 shows a cross-sectional view along line B—B in FIG. 3.

FIGS. 1 to 5 show an embodiment of the invention with a housing 1. The housing 1 comprises an annular base 7. Formed in the center of the housing 1 is a pot 2 which serves as a receiving region for the trunk. The opening of the pot 2 is adjoined at the top by a gently rising section of the housing 1 in which are provided openings 8, 9, 10 and 11 for the passage of holding elements 4. The openings/holding elements are spaced apart at intervals of 90°. Approximately in the center of said rising section, the housing wall is provided with an annular, inwardly directed deformation 20. Defined on the outside of said deformation 20 are two arc-shaped sections 14 which each accommodate a shaft pin 3 for supporting the holding elements 4. Radially outwardly and on either side of each of the openings 8, 9, 10 and 11, band-shaped sections 15 are pressed out of the housing wall thereby forming an opening. Said two band-shaped sections 15 complete the bearing for the shaft pin 3 by receiving a respective shaft pin 3 inserted through a respective holding element 4.

Figure 7:
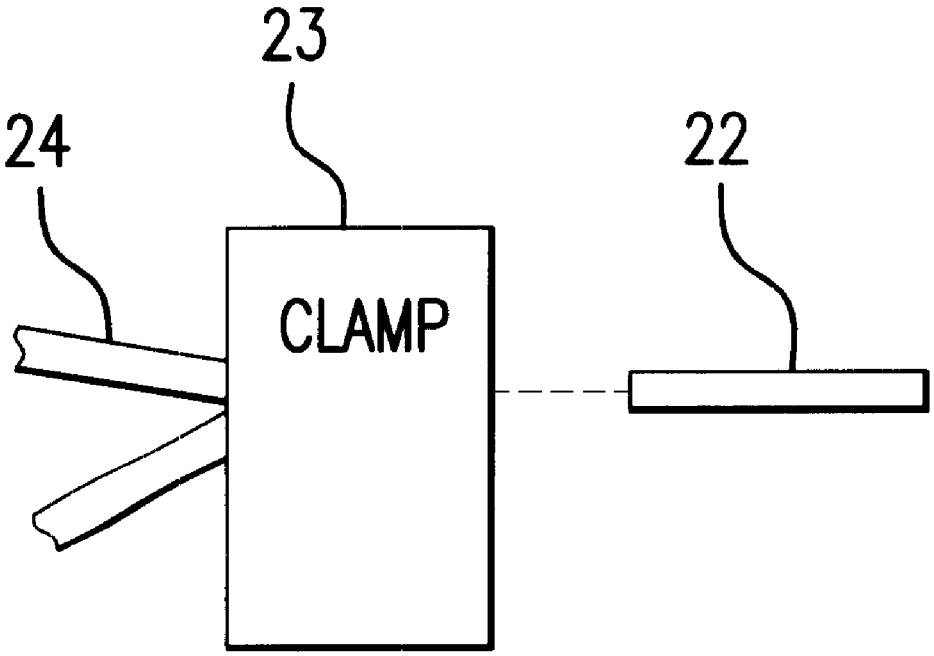
FIG. 7 shows an operating lever, a clamp apparatus and a force transmission element.

An operating lever 22 of a clamping apparatus 23, see FIG. 7, projects outwardly through an opening 12 in the housing wall. The operating lever and the clamping apparatus are used to clamp or release a force-transmission element 24 which is connected to all the holding elements. With regard to the details of said clamping apparatus, reference is made, for example, to DE 39 32 473 C2.

The force-transmission element acts in a region between the shaft pin 3 and the outer end of an outside leg 17 of the holding element 4. The force-transmission element may be in the form of a steel cable which is guided through openings 5 in the holding elements 4. For force redirection, the steel cable is guided through an opening 13 provided in the housing wall. In order to spare the steel cable, the edges of the opening 13 may be provided with material reinforcements. The clamping apparatus, attached to holding plates 16, is situated behind the opening 13, the holding plates 16 being attached to the inner wall of the housing. In a preferred embodiment, the holding plates 16 are attached by clamping to the inner wall of the housing, as is apparent, for example, in particular from FIG. 4.

The bottom 6 of the pot 2 and the base 7 of the housing 1 are preferably at the same level, with the result that the housing 1 can be stably placed on a foundation. The curved profile shape affords the housing 1 a particularly high degree of dimensional stability. The holding element 4 consists of the outside leg 17, which can be brought into contact with the trunk and which projects out of the housing 1, and of an inside leg 18, which is situated in the interior of the housing 1. Situated at the end of the inside leg 18 is a cutout 19, open on one side, into which a return spring 25, shown in FIG. 6*b*, in the form, for example, of a spiral spring, can be attached.

Figure 6B:
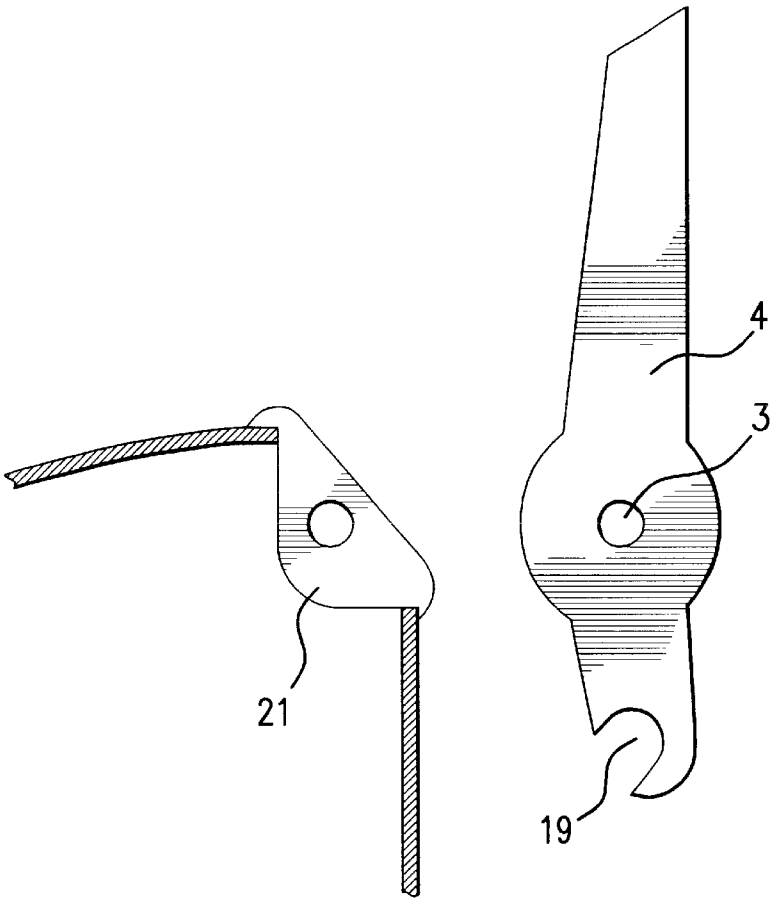
FIG. 6*b* being an exploded representation for a better representation of the bearing.
Figure 6A:
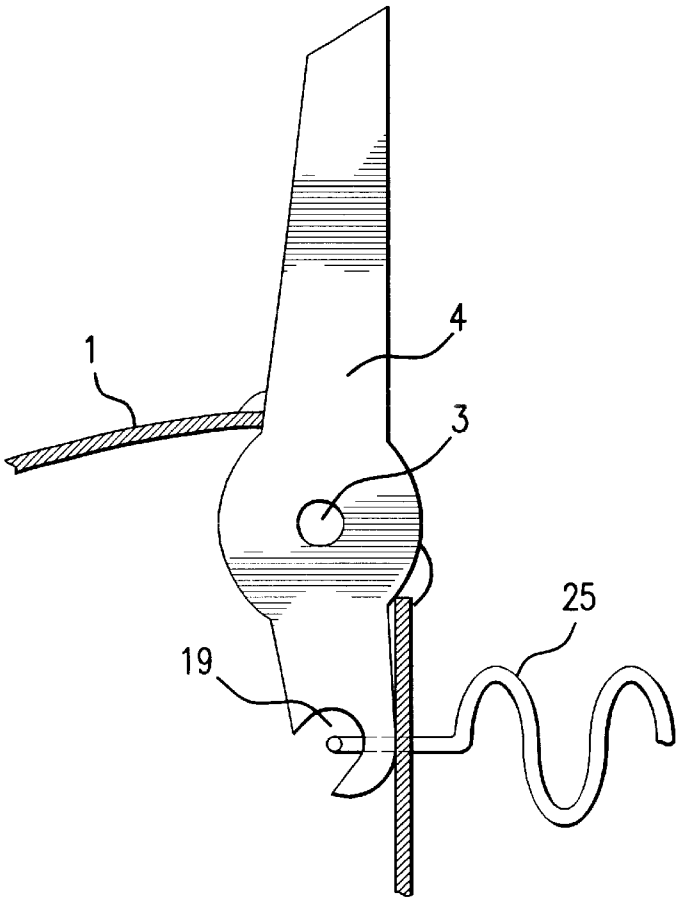
FIG. 6*a* shows a representation, corresponding to FIG. 5, of a different embodiment of the mounting of the holding element.

The embodiment shown in FIGS. 6*a* and 6*b* shows a modified form of the attachment of the holding elements 4 to the housing 1. Projecting out of the housing wall at right angles are two bearing supports 21 which each accept the shaft pin 3 for the swivel mounting of the holding element 4. As an alternative thereto, the bearing supports may also be separately manufactured and permanently connected to the housing wall.

What is claimed is:

1. A stand for perpendicularly erecting a tree trunk comprising:

a receiving region for receiving the tree trunk;

swivel bearings;

holding elements pivotably mounted in said swivel bearings;

a force transmission element acting onto said holding elements;

a clamping device for tensioning said force transmission element to move the holding elements into clamping engagement against the tree trunk; and a housing which together with the receiving region is formed as a one-piece design monolithic housing, including a ring shaped stand surface onto which the swivel bearings of the holding elements are formed and onto which the clamping device is held.

2. The stand according to claim 1, wherein the one piece design monolithic housing is made from a deep-drawn metal sheet.

3. The stand according to claim 1, wherein the receiving region for the trunk is in the form of a pot, said pot serving also to hold water.

4. The stand according to claim 3, wherein the pot and the one-piece design monolithic housing are deepdrawn from a common metal sheet.

5. A stand for perpendicularly erecting a tree trunk, comprising:

a receiving region for receiving the tree trunk;

swivel bearings;

holding elements pivotably mounted in said swivel bearings;

a force transmission element acting onto said holding elements;

a clamping device for tensioning said force transmission element to move the holding elements into clamping engagement against the tree trunk;

a shaft pin;

a housing which together with the receiving region is formed as a one-piece design monolithic housing, including a ring shaped stand surface onto which the swivel bearings of the holding elements are formed and onto which the clamping device is held; and at least one of the swivel bearings including two band-shaped sections pressed out of the monolithic housing thereby producing bearing openings and the shaft pin being inserted through a respective one of the holding elements and into the bearing opening to support the respective one of the holding elements.

6. The stand according to claim 5, wherein said at least one of the swivel bearings of the one-piece design monolithic housing includes arc-shaped deformations adjacent said band-shaped sections that hold the shaft pin in conjunction with the band-shaped sections.

7. The stand according to claim 6, wherein said at least one of the swivel bearings includes a plurality of swivel bearings.

8. The stand according to claim 1, further comprising:

a shaft pin; and at least one of the swivel bearings being formed of two sections of the one-piece design monolithic housing that project at right angles and serve as bearing supports for holding the shaft pin.

9. The stand according to claim 1, further comprising:

a shaft pin; and two bearing supports, wherein in order to form at least one of the swivel bearings the one-piece design monolithic housing has mounting portions adjacent an opening for receiving one of said holding elements and to which the two bearing supports are attached and hold the shaft pin.

10. The stand according to claim 1, wherein the one-piece design monolithic housing includes an opening for redirecting the force of the force transmission element.

11. The stand according to claim 1, further comprising two holding plates holding the clamping device and attached to an inner wall of the one-piece design monolithic housing.

12. The stand according to claim 11, wherein the holding plates are attached to the inner wall of the one-piece design monolithic housing by clamping.

13. The stand according to claim 5, further comprising an annularly disposed spiral spring, wherein:

the holding elements respectively include an outwardly projecting outside leg above the swivel bearings, and an inwardly projecting inside leg below the swivel bearings, and a cutout open on one side below the swivel bearing; and the holding elements are held in an open position by means of the annularly disposed spiral spring which engages the cutouts, of the inside legs of the holding elements.

14. The stand according to one of claim 1, wherein an underside of the one-piece design monolithic housing above the base is provided with a facing and protective cover.

15. The stand according to claim 2, wherein the metal sheet is one of an iron alloy and an aluminum alloy.

16. A stand for perpendicularly erecting a pole comprising:

a receiving region for receiving the pole;

bearing surfaces;

holding elements pivotably mounted on said bearing surfaces;

a force transmission element acting onto said holding elements;

a tensioning device for tensioning said force transmission element to move the holding elements into clamping engagement against the pole; and a housing which together with the receiving region is formed as a one piece design monolithic housing, including a ring shaped stand surface onto which the bearings of the holding elements are formed and onto which the tensioning device is held.

17. The stand according to claim 16, wherein the one-piece design monolithic housing is made from a deep-drawn metal sheet.

18. The stand according to claim 16, wherein the bearing surfaces form swivel bearings.

19. The stand according to claim 17, wherein the receiving region is a concavity in the one-piece design monolithic housing.

20. The stand according to claim 19, wherein the one-piece design monolithic housing and the receiving region are deepdrawn from a common metal sheet.

21. The stand according to claim 18, further comprising:

a shaft pin; and at least one of the swivel bearings including two band-shaped sections pressed out of the one-piece design monolithic housing thereby producing bearing openings and the shaft pin being inserted through a respective one of the holding elements and into the bearing opening to support the respective one of the holding elements.

22. The stand according to claim 21, wherein said at least one of the swivel bearings of the one-piece design monolithic housing includes arc-shaped deformations adjacent said band shaped sections that hold the shaft pin in conjunction with the band-shape sections.

23. The stand according to claim 22, wherein a least one of the swivel bearings includes a plurality of swivel bearings.

24. The stand according to claim 18, further comprising:

a shaft pin; and at least one of the swivel bearings being formed of two sections of the one-piece design monolithic housing that project at right angles and serve as bearing supports for holding the shaft pin.

25. The stand according to claim 18, further comprising a shaft pin;

and two bearing supports, wherein in order to form at least one of the swivel bearings the one-piece design monolithic housing has mounting portions adjacent an opening for receiving one of said holding elements and to which the two bearing supports are attached and hold the shaft pin.

26. The stand according to claim 16, wherein the one-piece design monolithic housing includes an opening for redirecting the force of the force transmission element.

27. The stand according to claim 16, further comprising two holding plates for holding the tensioning device and attaching to an inner wall of the one-piece design monolithic housing.

28. The stand according to claim 27, wherein the holding plates are attached to the inner wall of the one-piece design monolithic housing by clamping.

29. The stand according to claim 21, further comprising an annularly disposed spiral spring, wherein the holding elements respectively include an outwardly projecting outside leg above the swivel bearings, and an inwardly projecting inside leg below the swivel bearings, and a cutout open on one side below the swivel bearings; and the holding elements are held in an open position by means of the annularly disposed spiral spring which engages the cutouts, of the inside legs of the holding elements.

30. The stand according to one of claim 16, wherein an underside of the one-piece design monolithic housing above the base is provided with a facing and protective cover.

31. The stand according to claim 1, wherein the swivel bearings project from the monolithic housing.

32. The stand according to claim 16, wherein the bearing surfaces project from the monolithic housing.

* * * * *